United States Patent [19]

Otobe et al.

[11] Patent Number: 4,700,675

[45] Date of Patent: Oct. 20, 1987

[54] METHOD OF CONTROLLING FUEL SUPPLY FOR INTERNAL COMBUSTION ENGINE AT IDLE

[75] Inventors: Yutaka Otobe, Shiki; Akira Kato, Itabashi; Masataka Chikamatsu, Asaka, all of Japan

[73] Assignee: Honda Giken Kogyo K.K., Tokyo, Japan

[21] Appl. No.: 867,771

[22] Filed: May 28, 1986

[30] Foreign Application Priority Data

May 31, 1985 [JP] Japan ..... 60-117963

[51] Int. Cl.[4] ..... F02M 3/07

[52] U.S. Cl. ..... 123/339; 123/478

[58] Field of Search ..... 123/339, 478, 585; 364/431.05, 431.07

[56] References Cited

U.S. PATENT DOCUMENTS 4,513,710 4/1985 Kobayashi et al. ..... 123/339
4,570,592 2/1986 Otobe ..... 123/339
4,572,127 2/1986 Morris ..... 123/339
4,583,174 4/1986 Watanabe ..... 123/339 X
4,603,668 8/1986 Ueno ..... 123/339 X
4,611,560 9/1986 Miyazaki et al. ..... 123/339

FOREIGN PATENT DOCUMENTS 0176424 10/1983 Japan .

*Primary Examiner*—Willis R. Wolfe, Jr.
*Attorney, Agent, or Firm*—Arthur L. Lessler

[57] ABSTRACT

A fuel supply control method for internal combustion engines, which is capable of stabilizing the engine rotational speed to a desired idling speed immediately after the rotational speed of the engine at idle suddenly changes due to an external disturbance such as a change in the electrical load on the engine. The fuel quantity to be supplied to the engine is determined in accordance with operating conditions of the engine in the idling condition, and the determined fuel quantity is corrected by a correction value which is determined in response to the difference between a desired idling speed of the rotational speed of the engine and an actual value thereof. When the absolute value of a detected rate of change in the rotational speed of the engine is larger than a predetermined value, the correction value is corrected to thereby correct the determined fuel quantity.

11 Claims, 5 Drawing Figures

METHOD OF CONTROLLING FUEL SUPPLY FOR INTERNAL COMBUSTION ENGINE AT IDLE

BACKGROUND OF THE INVENTION

This invention relates to a method of controlling fuel supply for an internal combustion engine at idle, and more particularly to a method of this kind which is intended to stabilize engine rotational speed when the engine is operating in an idling condition.

It is desirable that an internal combustion engine rotates stably at a desired idling speed in accordance with a condition in which the engine is operating in an idling region. However, change in engine load can actually cause it difficult to keep the engine rotational speed at the desired idling speed.

It is conventionally known e.g. from Japanese Provisional Patent Publication (Kokai) No. 58-176424 to increase or decrease the quantity of fuel supplied to the engine during idling, in a manner responsive to the difference between the actual engine rotational speed and a desired idling speed.

According to the above known method, the actual engine rotational speed is detected and compared with the desired idling speed. If the actual engine rotational speed is below the desired idling speed, the fuel quantity is increased by a correction value corresponding to the difference. On the other hand, if the actual engine rotational speed is above the desired idling speed, the fuel quantity is decreased by a correction value corresponding to the difference.

However, according to the known method, if the load on the engine suddenly changes due to an external disturbance e.g. increased or decreased electrical load on the engine, etc., the engine rotational speed can suddenly drop or rise across the desired idling speed (overshooting), often resulting in hunting of the engine rotation. To be specific, when the engine rotational speed starts suddenly increasing toward the desired idling speed due to a sudden decrease in the engine load, the fuel supply quantity is corrected to an increased value while the actual engine rotational speed is below the desired idling speed. As a result, the engine rotational speed can largely surpass the desired idling speed. On the contrary, when the engine rotational speed suddenly decreases toward the desired idling speed due to a sudden increase in the engine load, the fuel supply quantity is corrected to a decreased value while the actual engine rotational speed is above the desired idling speed, so that the engine rotational speed can largely drop below the desired idling speed.

Thus, the known method is involved in a problem of hunting of the engine rotation due to a sudden change in the engine rotational speed.

SUMMARY OF THE INVENTION

It is the object of the present invention to provide a fuel supply control method for internal combustion engines, which is capable of stabilizing the engine rotational speed to a desired idling speed immediately after the rotational speed of the engine at idle suddenly changes due to an external disturbance such as a change in the electrical load on the engine.

According to a first aspect of the invention, there is provided a method of controlling the quantity of fuel to be supplied to an internal combustion engine while it is operating in an idling condition, wherein the fuel quantity is determined in accordance with operating conditions of the engine in the idling condition, and the determined fuel quantity is corrected by a correction value which is determined in response to the difference between a desired idling value of the rotational speed of the engine and an actual value thereof. The method according to the invention is characterized by comprising the following steps: (1) detecting a rate of change in the rotational speed of the engine; (2) correcting the correction value when the absolute value of the detected rate of change is larger than a predetermined value; and (3) correcting the determined fuel quantity by the correction value thus corrected.

Preferably, the rate of change in the rotational speed of the engine is the difference between an average value of values of the rotational speed of the engine assumed during idling and an actual value of the rotational speed of the engine.

Preferably, the average value of the engine rotational speed has an initial value thereof set to a desired idling value dependent upon a temperature of the engine.

Also preferably, the step (3) is executed only when the rotational speed of the engine is varying toward the average value of the engine rotational speed.

Further preferably, the step (2) comprises correcting the correction value to 0.

According to a second aspect of the invention, there is provided a method of controlling the quantity of fuel to be supplied to an internal combustion engine while it is operating in an idling condition, wherein the fuel quantity is determined in accordance with operating conditions of the engine in the idling condition, and the determined fuel quantity is corrected by a correction value which is determined in response to the difference between a desired idling value of the rotational speed of the engine and an actual value thereof, the method comprising the steps of: (1) detecting whether the rotational speed of the engine is varying toward a predetermined value or away from same; (2) correcting the correction value when the rotational speed of the engine is detected to be varying toward the predetermined value; and (3) correcting the determined fuel quantity by the correction value thus corrected.

Preferably, the method includes detecting a rate of change in the rotational speed of the engine, and wherein the correction of the corrected value in the step (2) is executed only when the absolute value of the detected rate of change is larger than a predetermined value.

The above and other objects, features and advantages of the invention will be more apparent from the ensuing detailed description taken in conjunction with the accompanying drawings.

DETAILED DESCRIPTION

The method of the invention will now be described in detail with reference to the drawings.

Figure 1:
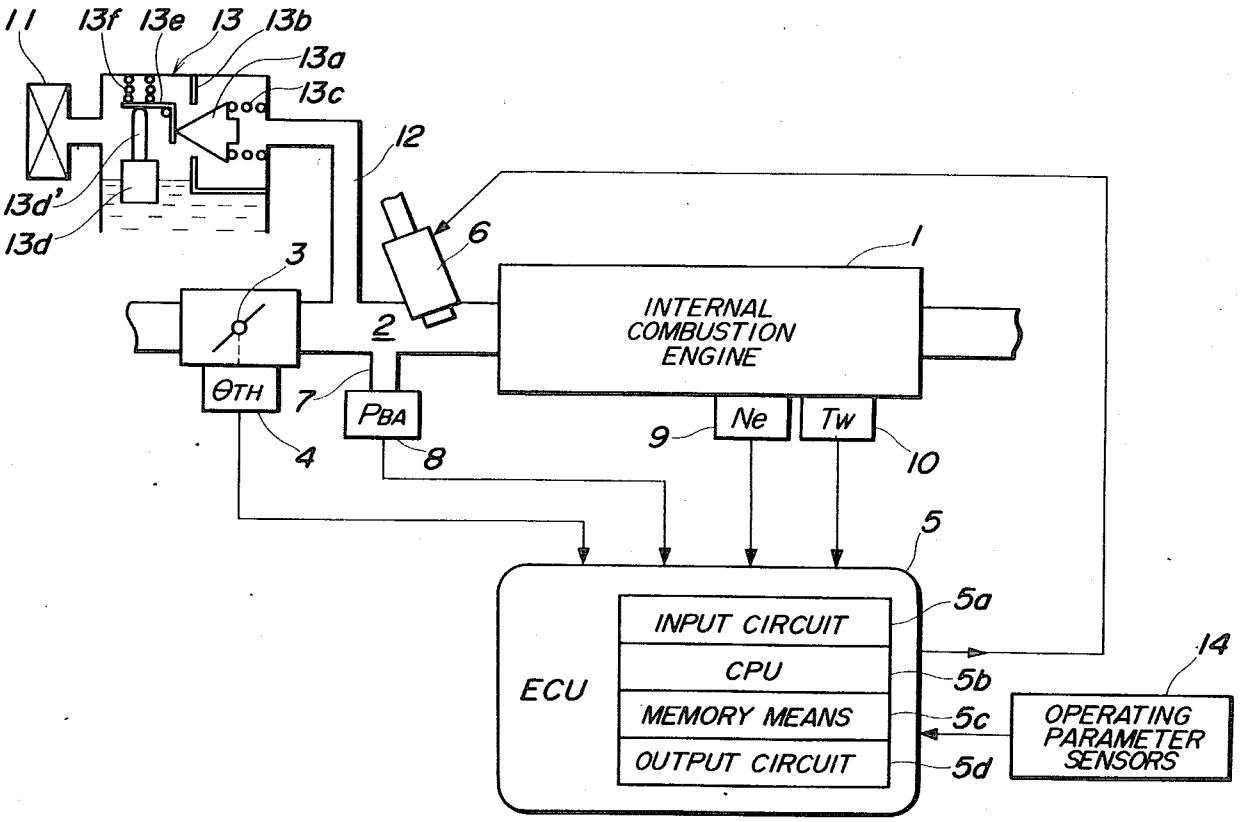
FIG. 1 is a block diagram illustrating the whole arrangement of a fuel quantity control system for internal combustion engines, to which is applied the method of the invention.

FIG. 1 illustrates the whole arrangement of a fuel quantity control system for internal combustion engines, to which is applied the method of the invention. In FIG. 1, reference numeral 1 designates an internal combustion engine which may be a four-cylinder type, for instance. An intake pipe 2 is connected to the engine 1, in which is arranged a throttle valve 3 which in turn is coupled to a throttle valve opening sensor ($\theta$th sensor) 4 for detecting its valve opening and converting same into an electrical signal supplied to an electronic control unit (hereinafter called "the ECU") 5, electrically connected thereto.

Fuel injection valves 6 are arranged in the intake pipe 2 in the vicinity of respective intake air valves, not shown, of the engine 1. These injection valves 6 are connected to a fuel pump, not shown, and also electrically connected to the ECU 5. A conduit 12 extends from the intake pipe 2 at a location downstream of the throttle valve 3, and communicates with the atmosphere by the way of an air cleaner 11. Arranged across the conduit 12 is a fast idling control valve 13 which controls the quantity of supplementary air to be supplied to the engine 1. The fast idling control valve 13 comprises, for example, a valve body 13*a* disposed to be urged against its valve seat 13*b* by a spring 13*c* for closing the conduit 12, a sensor 13*d* adapted to stretch or contract its arm 13*d'* in response to the engine coolant temperature, and a lever 13*e* pivotable in response to the stretching and contracting action of the arm 13*d'* of the sensor 13*d* for displacing the valve body 13*a* so as to open or close the conduit 12. An absolute pressure sensor (PBA sensor) 8 is arranged at a location downstream of the throttle valve 3 through a conduit 7, to detect absolute pressure in the intake pipe 2 and apply an electrical signal indicative of the detected absolute pressure to the ECU 5. An engine rotational speed sensor (Ne sensor) 9 is arranged in facing relation to a camshaft, not shown, of the engine 1 or a crankshaft, not shown, of same, and adapted to generate one pulse at a particular crank angle position of each of the engine cylinders, which is in advance of the top-dead-center position (TDC) of a piston in the cylinder immediately before its suction stroke by a predetermined crank angle. Pulses generated by the Ne sensor are supplied as a TDC signal to the ECU 9. An engine coolant temperature (TW) sensor 10 is mounted in the cylinder block of the engine 1 for detecting the engine coolant temperature TW as representing the engine temperature and converting same into an electrical signal which is supplied to the ECU 5.

Other operating parameter sensors 14 such as an atmospheric pressure (PA) sensor 18 and an $O_2$ sensor are all electrically connected to the ECU 5 to supply same with electric signals indicative of the respective detected operating parameter values.

The ECU 5 comprises an input circuit 5*a* having functions of shaping waveforms of pulses of input signals from sensors such as the aforementioned Ne sensor 9, shifting voltage levels of input signals from analog sensors such as the PBA sensor 8 and the TW sensor 10, etc., a central processing unit (hereinafter called "the CPU") 5*b*, memory means 5*c* storing various control programs executed within the CPU 5*b* as well as for storing various calculated data from the CPU 5*b*, and an output circit 5*d* for supplying driving signals to the fuel injection valves 6.

The CPU 5*b* in the ECU 5 operates in response to various engine operating parameter signals as stated above, to determine operating conditions of the engine and to calculate the fuel injection period TOUT of the fuel injection valves 6, by the use of the following equations (1) and (2), in accordance with the determined operating conditions of the engine:

$$TOUT = Ti \times K + K2 \quad (1)$$

$$TOUT = TOUT + TAIC \quad (2)$$

where Ti in the equation (1) represents a basic value of the fuel injection period TOUT which is read from the memory means 5*c* in response to engine rotational speed Ne and intake pipe absolute pressure PBA. K1 and K2 represent correction coefficients and correction variables, respectively, which are calculated on the basis of values of various engine operating parameter signals from the aforementioned various sensors such as the throttle valve opening sensor 4, the intake pipe absolute pressure sensor 8, the Ne sensor 9, the engine coolant temperature sensor 10, and other operating parameter sensors 14. These correction coefficients K1 and correction variables K2 are calculated by the use of respective predetermined equations stored in the memory means 5*c* to such values as to optimize various operating characteristics of the engine such as startability, emission characteristics, fuel consumption, and accelerability.

TOUT on the right side of the equation (2) represents the valve opening period calculated by the equation (1), to which is added a correction variable TAIC according to the invention, to obtain a corrected valve opening period TOUT on the left side of the equation (2). TAIC is set to a value in accordance with the difference between the actual engine rotational speed Ne and an average value NeAVE of values of engine rotational speed Ne assumed during idling, which is applied as the desired idling speed, as well as with the rate of change in the engine rotational speed, during idling speed feedback control, details of which will be described later.

The ECU 5 operates, on the basis of the fuel injection period TOUT determined as above, to supply the fuel injection valves 6 with driving signals for opening same, through the output circuit 5*d*.

Within the CPU 5*b* instead of the engine rotational speed Ne, the value ME corresponding to the reciprocal of the engine rotational speed Ne is used for various calculations to facilitate the calculations, as discribed later. The value Me represents the time interval between adjacent pulses of the TDC signal generated by the Ne sensor 9, and is smaller as the engine rotational speed is higher.

The fast idling control valve 13 shown in FIG. 1 operates as follows:

The fast idling control valve 13 operates when the engine coolant temperature is lower than a predetermined value (e.g. 76° C.), such as at the start of the engine in a cold state. More specifically, the sensor 13*d* stretches or contracts its arm 13*d'* in response to a change in the engine coolant temperature. This sensor 13*d* may be formed by any thermo-sensitive material, such as wax filled within a casing, which is thermally expandable. When the engine coolant temperature TW is lower than the predetermined value, the arm 13*d'* is in a contracted state, with the lever 13*e* biased by the force of a spring 13*f* in such a position as to hold the valve body 13*a* in a rightward position, as viewed in FIG. 1, against the force of the spring 13*c* whereby the conduit 12 is open. Thus, the open conduit 12 allows the supply of a sufficient amount of supplementary air corresponding to the engine coolant temperature TW to the engine 1 through the air cleaner 11 and the conduit 12, when the engine coolant temperature TW is lower than the predetermined value, so that the engine rotational speed can be maintained at a higher value than a normal idling speed, thereby ensuring smooth and stable idling operation of the engine even in a cold state without engine stall.

As the arm 13*d'* of the sensor means 10*d* is stretched with an increase in the engine coolant temperature due to warming-up of the engine, it pushes the lever 13*e* upward to rotate same in the clockwise direction, as viewed in FIG. 1. Then, the valve body 13*a* becomes moved leftward by the force of the spring 13*c*. When the engine coolant temperature exceeds the predetermined value (76° C.), the valve body 13*a* comes into urging contact with the valve seat 13*b* to close the conduit 12, thereby interrupting the supply of supplementary air through the fast idling control valve 13.

Figure 4:
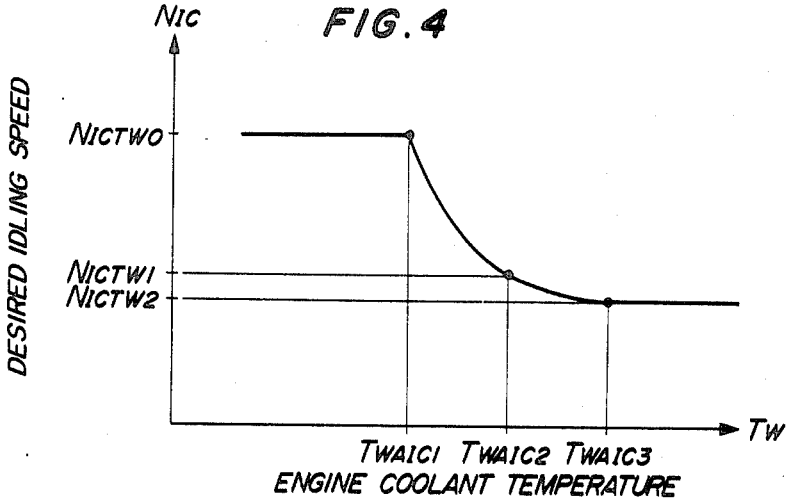
FIG. 4 is a graph illustrating values NICi of desired idling speed NIC to be attained by a fast idling control value appearing in FIG. 1 in response to the engine coolant temperature TW.

In this way, the fast idling control valve 13 controls, in accordance with engine coolant temperature, the engine rotational speed Ne to such a desired value (hereinafter called "idling speed NIC") that prevents engine stall. The relationship between the engine coolant temperatue TW and the idling speed NIC to be attained by the fast idling control valve 13 is shown in FIG. 4.

Figure 2:
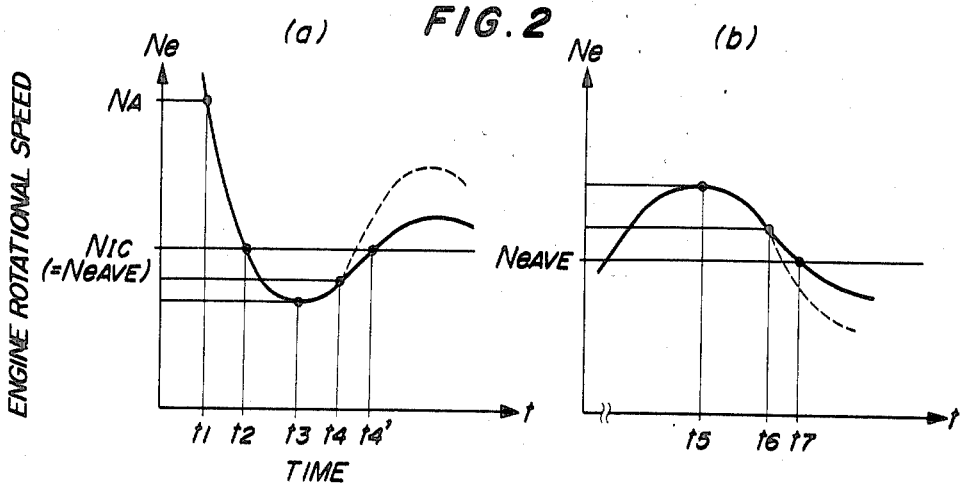
FIGS. 2 (*a*), (*b*) are graphs showing changes in the engine rotational speed during idling with respect to the lapse of time, given by way of example.
Figure 3:
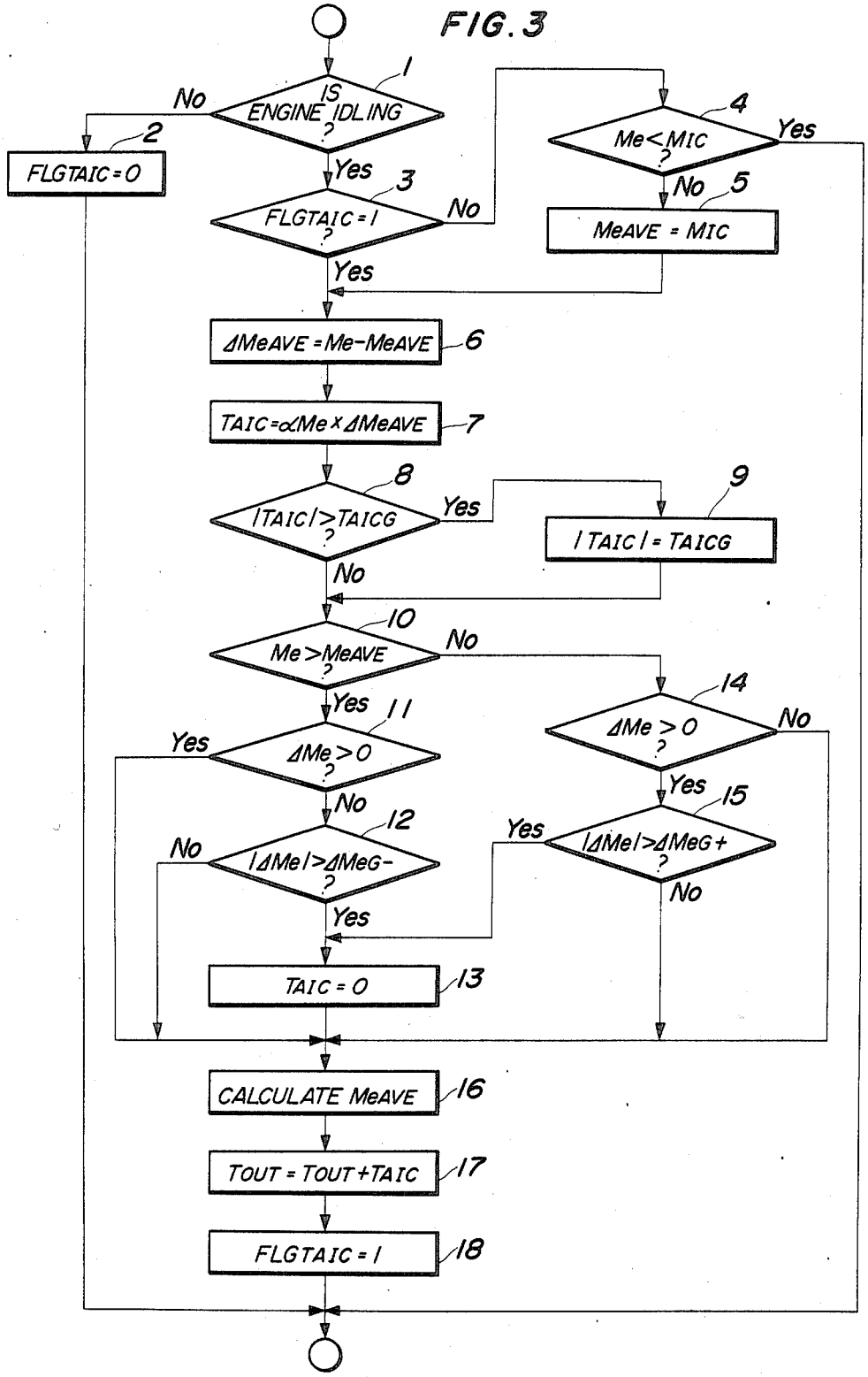
FIG. 3 is a flow chart showing a manner of determining a fuel quantity correction variable to be applied during idling operation of the engine.

Next, a manner of controlling the quantity of fuel supplied to the engine at idle, according to an embodiment of the invention, will be explained with reference to FIG. 2 showing a change in the engine rotational speed Ne with respect to the lapse of time, as well as FIG. 3 showing a flow chart of the control program. The control program shown in FIG. 3 is executed in synchronism with generation of TDC signal pulses by the CPU 5*b* in the ECU 5.

First, it is determined at the step 1 whether or not the engine is operating in the idling region wherein fuel supply feedback control for attaining the desired idling speed should be executed. This determination is made as to whether or not the following three conditions are fulfilled at the same time:

(1) The value Me corresponding to the reciprocal of the engine rotational speed Ne is larger than a value MA corresponding to the reciprocal of an engine rotational speed value NA larger by a predetermined value than the idling speed NIC;

(2) The valve opening $\theta$TH of the throttle valve 3 is smaller than a predetermined value $\theta$IDLL that can be assumed by the throttle valve 3 in a substantially fully closed state; and (3) The engine coolant temperature TW assumes a higher value than a predetermined value TWAIC1 (e.g. 66° C.), at which the influence of the action of the fast idling control valve 7 upon the idling control is small.

Figure 5:
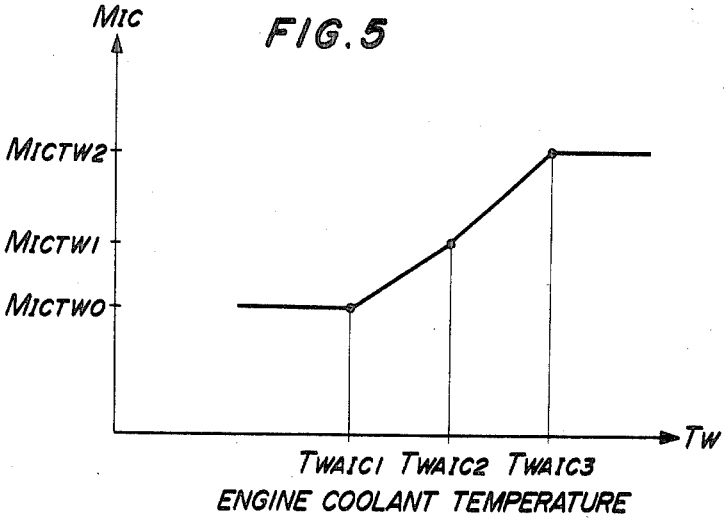
FIG. 5 is a graph illustrating the relationship between values MICi corresponding to the reciprocal of the idling speed NIC and the engine coolant temperature TW.

If the answer to the question of the step 1 is negative or no [before the time t1 in FIG. 2 (*a*)], the program is terminated after setting a flag FLGTAIC indicative of whether or not fuel supply feedback control was effected in the last loop, hereinafter referred to, to 0 at the step 2. If the answer at the step 1 is affirmative or yes, the program proceeds to the step 3 wherein it is determined whether or not the fuel supply feedback control was effected in the last loop, by checking whether the flag FLGTAIC value is 1 or not. If the result at the step 3 is negative or no, that is, if it is determined for the first time that the fuel supply feedback control should be effected in the present loop, then a determination is made at the step 4 as to whether or not the value Me is smaller than a predetermined value MIC. The predetermined value MIC corresponds to the reciprocal of the aforementioned idling speed NIC and is determined in accordance with the engine coolant temperature TW, as shown in FIG. 5 showing the relationship between the engine coolant temperature TW and the value MIC corresponding to the reciprocal of the value NIC. The graph of FIG. 5 is substantially identical with the graph of FIG. 4 except for the replacement of the value NIC by the value MIC. In FIG. 5, when the engine coolant temperature TW is below a predetermined value TWAIC1 and above a predetermined value TWAIC3 (76° C.), the value MIC is set to a predetermined value MICTW0 (corresponding to 900 rpm) and MICTW2 (corresponding to 750 rpm), respectively. When the engine coolant temperature TW is above TWAIC1 and below TWIC3, three predetermined values MICTW0, MICTW1 (e.g. a value corresponding to 830 rpm), and MICTW2 are selected, respectively, as the engine coolant temperature TW assumes three engine coolant temperature values TWAIC1, TWAIC2 (71° C.), and TWAIC3. When the engine coolant temperature shows a value other than one of the values TWAIC1–TWAIC3, the value MIC is determined by a known interpolation method.

If the determination result at the step 4 is affirmative or yes, that is, if the engine rotational speed Ne is higher than the value NIC [during the time period between the time points t1 and t2 in FIG. 2 (*a*)], the program is terminated without executing a fuel quantity correction by the fuel supply correction variable TAIC. If the determination result at the step 4 is negative or no [at the time of generation of a pulse of the TDC signal generated immediately after the engine rotational speed decreases across the value NIC in FIG. 2 (*a*)], the initial value of a value MeAVE (hereinafter merely called "the average value MeAVE"), which corresponds to the reciprocal of an average value NeAVE of values of the rotational speed of the engine assumed at idle, is set to the aforementioned value MIC, at the step 5. Then, the program proceeds to the step 6 wherein the difference ΔMeAVE between the average value MeAVE which is determined at the step 5 or at the step 16, hereinafter referred to, and the value Me detected at the time of generation of the present pulse of the TDC signal is calculated. And then, the fuel quantity correction variable TAIC is calculated at the step 7 by multiplying the value MeAVE calculated at the step 6 by a fixed coefficient $\propto$ME. Next, the program proceeds to the step 8 wherein it is determined whether or not the absolute value |TAIC| of the calculated fuel quantity variable value TAIC is larger than a predetermined maximum allowable value TAICG. If it is determined that the absolute value |TAIC| is larger than the predetermined maximum allowable value TAICG, the absolute value |TAIC| is corrected to the value TAICG at the step 9. Then, the program proceeds to the step 10. If the determination result at the step 8 is negative or no, the program jumps to the step 10, bypassing the step 9. As described above, large fluctuations in the engine rotational speed due to feedback control can be prevented by limiting the upper limit of the absolute value |TAIC| to the predetermined value TAICG.

Next, it is determined at the step 10 whether or not the value Me is larger than the average value MeAVE. If the answer to the question of the step 10 is affirmative or yes, that is, if the engine rotational speed Ne is smaller than the average value NeAVE of values of idling speed [during the time period between the time points t2 and t4' in FIG. 2(*a*)], the program proceeds to the next step 11, wherein a determination is made as to whether or not the rate of change ΔMe of the value Me is larger than 0. The rate ΔMe is calculated as the difference (=Men−Men-1) between the present value of the value Me and the last value Men-1 of same. If the value ΔMe is positive, it means that the engine rotational speed Ne is decreasing. On the contrary, if negative, it means that the engine rotational speed Ne is increasing. If the determination result at the step 11 is affirmative or yes, that is, if the engine rotational speed Ne is decreasing in the direction away from the average value NeAVE [during the time period between the time points t2 and t3 in FIG. 2 (*a*)], the program proceeds to the step 16 without newly correcting the value TAIC. In the step 16, an average value MeAVEn of the value Me assumed during idling of the engine is calculated by the use of the following equation (3):

$$MeAVE = \frac{MREF}{256} \times Men + \frac{256 - MREF}{256} \times MeAVEn - 1 \quad (3)$$

where MeAVEn represents the average value determined in the present loop, and MeAVEn-1, one determined in the last loop. MREF represents a coefficient which is set at a predetermined integral value between 0 and 256. The MREF value is determined depending on dynamic characteristics of the engine during idling operation, etc.. Men represents, as mentioned above, the value Me detected at the time of generation of the present pulse of the TDC signal. Incidentallv, the initial value of the average value MeAVE is set to the value MIC at the step 5, as mentioned before, and the subsequent MeAVE value is stored in the memory means 5*c* in FIG. 1, each time it is calculated by the above equation (3).

Next, at the step 17, a value of the valve opening period TOUT of the fuel injection valves 6 calculated by the equation (1) is corrected by a value of the fuel quantity correction variable TAIC, by the use of the equation (2). The corrected valve TOUT is employed as the valve opening period. Then, at the step 18, the flag value FLGTAIC is set to 1 to memorize that the fuel supply feedback control has been executed in the present loop, and then the program is terminated.

If the determination result at the step 1 is still affirmative or yes at the time of generation of the next pulse of the TDC signal, the determination at the step 3 is made again. As the fuel supply feedback control was executed in the last loop, as mentioned above, the determination result at the step 3 is affirmative or yes. Then, the program skips the steps 4 and 5 to execute the step 6. If the engine rotational speed Ne increases toward the average value NeAVE after engine deceleration [at the time point t3 in FIG. 2 (*a*)], the answer to the question of the step 11 is negative or no, and the program proceeds to the step 12, wherein it is determined whether or not the absolute value |ΔMe| of the rate of change ΔMe is larger than a predetermined value ΔMeG−. If the answer at the step 12 is negative or no, the step 16 et seg. are immediately executed to correct the fuel supply quantity by the correction variable TAIC. On the contrary, if the answer to the question of the step 12 is affirmative or yes, that is, if the engine rotational speed Ne is abruptly increasing due to a reduction in the engine load or the like [at the time point t4 in FIG. 2 (*a*)], the program proceeds to the step 13 wherein the fuel quantity correction variable TAIC is corrected to 0. Accordingly, the fuel quantity correction by the correction variable TIAC is prohibited in the present loop, to thereby prevent abrupt increase of the engine rotational speed Ne [which would otherwise occur along the dashed line in FIG. 2 (*a*)]. Thus, the engine rotational speed Ne slowly increases along the solid line after the time point t4.

When the engine rotational speed exceeds the average value NeAVE, the determination result at the step 10 is negative or no. Then, the program proceeds to the step 14 wherein it is determined whether or not the rate of change ΔMe of the value Me is larger than 0 in the same manner as the step 11. If the determination result is negative or no, that is, if the engine rotational speed Ne is increasing in the direction away from the average value NeAVE [before the time point t5 in FIG. 2 (*b*)], the program proceeds to the step 16 without correcting the value TAIC. On the other hand, if the result at the step 11 is affirmative or yes [during the time period between the time points t5–t7 in FIG. 2 (*b*)], it is determined at the step 15 whether or not the absolute value |ΔMe| of the rate of change ΔMe is larger than a predetermined value ΔMeG−. If the answer to the question at the step 15 is negative or no, the fuel supply quantity is continually corrected or decreased by the value TAIC calculated at the step 7 or the step 9. If the answer at the step 15 is affirmative or yes, that is, if the engine rotational speed Ne is abruptly decreasing toward the average value NeAVE [at the time point t6 in FIG. 2 (*b*)], the aformentioned step 13 is executed to correct the fuel quantity correction variable TAIC to 0, to thereby prevent abrupt decrease [which could otherwise occur along the dashed line in FIG. 2 (*b*)] of the engine rotational speed Ne and obtain a slow drop in the engine speed along the solid line after the time point t6 in FIG. 2 (*b*).

According to the present embodiment, the calculation of the fuel quantity correction variable TAIC at the step 7 is effected by multiplying the difference ΔMeAVE between the value Me and the average value MeAVE, corresponding, respectively, to the actual engine rotational speed Ne and the average value of values of same assumed during engine idle, by the fixed predetermined coefficient ΔMe. However, other methods may be employed for calculation of the correction variable TAIC, such as one using the value ΔMe representative of the rate of change in engine rotational speed.

Further, although at the step 13 the fuel supply correction variable TAIC is corrected to 0, the value TAIC may be corrected to a value other than 0, insofar as it is smaller than the absolute value |TAIC| determined at the steps 7–9.

As described above, according to the invention, the rate of change in the engine rotational speed is detected during idling operation of the engine, the fuel quantity correction value is determined in accordance with the detected rate of change in the engine rotational speed, and the quantity of fuel to be supplied to the engine during idling is corrected by the determined correction value. It is therefore possible to stabilize the idling speed even when the engine rotational speed suddenly changes due to an external disturbance such as a change in the electrical load, and to thereby prevent hunting in the engine rotation.

What is claimed is:

1. A method of controlling the quantity of fuel to be supplied to an internal combustion engine while it is operating in an idling condition, wherein the fuel quantity is determined in accordance with operating conditions of the engine in the idling condition, and the determined fuel quantity is corrected by a correction value which is determined in response to the difference between a desired idling value of the rotational speed of the engine and an actual value thereof, the method comprising the steps of:

(1) detecting whether the rotational speed of the engine is varying toward a predetermined value or away from same;

(2) correcting said correction value to a smaller value when the rotational speed of the engine is detected to be varying toward said predetermined value; and (3) correcting the determined fuel quantity by the correction value thus corrected.

2. A method as claimed in claim 1, including detecting a rate of change in the rotational speed of the engine, and wherein the correction of said corrected value in said step (2) is executed only when the absolute value of the detected rate of change is larger than a predetermined value.

3. A method of controlling the quantity of fuel to be supplied to an internal combustion engine while it is operating in an idling condition, wherein the fuel quantity is determined in accordance with operating conditions of the engine in the idling condition, and the determined fuel quantity is corrected by a correction value which is determined in response to the difference between a desired idling value of the rotational speed of the engine and an actual value thereof, the method comprising the steps of:

(1) setting said desired idling value at an average value of values of the rotational speed of the engine assumed during idling, said average value having an initial value dependent upon a temperature of the engine;

(2) detecting a rate of change in the rotational speed of the engine;

(3) correcting said correction value when the absolute value of the detected rate of change is larger than a predetermined value; and (4) correcting the determined fuel quantity by the correction value thus corrected.

4. A method as claimed in claim 3, wherein said step (3) comprises correcting said correction value to 0.

5. A method of controlling the quantity of fuel to be supplied to an internal combustion engine while it is operating in an idling condition, wherein the fuel quantity is determined in accordance with operating conditions of the engine in the idling condition, and the determined fuel quantity is corrected by a correction value which is determined in response to the difference between a desired idling value of the rotational speed of the engine and an actual value thereof, the method comprising the steps of:

(1) detecting a rate of change in the rotational speed of the engine;

(2) correcting said correction value which is determined in response to the difference between a desired idling value of the rotational speed of the engine and an actual value thereof, when the absolute value of the detected rate of change is larger than a predetermined value; and (3) correcting the determined fuel quantity by the correction value thus corrected.

6. A method as claimed in claim 5, wherein the desired idling value of the rotational speed of the engine is an average value of values of the rotational speed of the engine assumed during idling.

7. A method as claimed in claim 6, wherein said average value of the engine rotational speed has an initial value thereof set to a desired idling value dependent upon a temperature of the engine.

8. A method as claimed in claim 6, wherein said step (3) is executed only when the rotational speed of the engine is varying toward said average value of the engine rotational speed.

9. A method as claimed in claim 5, 6, 7 or 8, wherein said step (2) comprises correction value to 0.

10. A method as claimed in claim 5, 6, 7 or 8, wherein the rotational speed of the engine is detected each time a pulse of a predetermined timing signal is generated, and said rate of change in the rotational speed of the engine is the difference between values of the rotational speed of the engine detected, respectively, upon generations of a present pulse and a preceding pulse of said predetermined timing signal during idling.

11. A method as claimed in claim 10, wherein said predetermined timing signal is a signal indicative of predetermined crank angle positions of the engine.

* * * * *